US009034111B2

(12) United States Patent
Dorshimer et al.

(10) Patent No.: US 9,034,111 B2
(45) Date of Patent: May 19, 2015

(54) ENGINE WASH SYSTEM AND METHOD

(75) Inventors: Kurt D. Dorshimer, Fayetteville, GA (US); Robert M. Rice, Huntsville, AL (US); Sebastian Nordlund, Sundbyberg (SE); Wayne Zadrick, Bristol, CT (US)

(73) Assignee: EcoServices, LLC, Farmington, CT (US)

( * ) Notice: Subject to any disclaimer, the term of this patent is extended or adjusted under 35 U.S.C. 154(b) by 333 days.

(21) Appl. No.: 13/562,883

(22) Filed: Jul. 31, 2012

(65) Prior Publication Data

US 2014/0034091 A1 Feb. 6, 2014

(51) Int. Cl.
*F01D 25/00* (2006.01)
*B08B 3/02* (2006.01)

(52) U.S. Cl.
CPC ..... *B08B 3/02* (2013.01); *F01D 25/002* (2013.01)

(58) Field of Classification Search
None
See application file for complete search history.

(56) References Cited

U.S. PATENT DOCUMENTS

| | | | | |
|---|---|---|---|---|
| 3,623,668 | A | 11/1971 | Freid et al. | |
| 4,196,020 | A | 4/1980 | Hornak et al. | |
| 5,011,540 | A | 4/1991 | McDermott | |
| 5,868,860 | A * | 2/1999 | Asplund | 134/22.1 |
| 6,630,198 | B2 | 10/2003 | Ackerman et al. | |
| 6,932,093 | B2 | 8/2005 | Ogden et al. | |
| D548,899 | S | 8/2007 | Asplund | |
| 7,445,677 | B1 * | 11/2008 | Asplund | 134/24 |
| 7,497,220 | B2 | 3/2009 | Asplund et al. | |
| 7,815,743 | B2 | 10/2010 | Asplund et al. | |
| 2006/0219269 | A1 | 10/2006 | Rice et al. | |
| 2011/0146729 | A1 | 6/2011 | Giljohann et al. | |

FOREIGN PATENT DOCUMENTS

| | | | |
|---|---|---|---|
| CH | 699129 | A2 * | 1/2010 |
| JP | 2000042505 | A | 2/2000 |

OTHER PUBLICATIONS

English Abstract of Ch 699129 A2.*
International Search Report and Written Opinion from PCT Application Serial No. PCT/US2013/052941, dated Oct. 25, 2013, 11 pages.

* cited by examiner

*Primary Examiner* — Nicole Blan
(74) *Attorney, Agent, or Firm* — Kinney & Lange, P.A.

(57) ABSTRACT

An engine wash system includes a manifold to secure to a nose cone of an engine; a feeder pipe connecting to the manifold to deliver wash liquid to the manifold; a plurality of nozzles connected to the manifold to direct the wash liquid into the engine; a hook connected to the manifold to connect to a slot on the nose cone; and a guide connected to the feeder to align the manifold relative to the engine.

20 Claims, 5 Drawing Sheets

ENGINE WASH SYSTEM AND METHOD

BACKGROUND

Through use, gas turbine engines become subject to buildup of contaminants on engine components. These contaminants can corrode engine components and affect overall performance of the engine. Engine washing can help to remove these contaminants and improve engine performance and efficiency.

Conventional engine wash processes are accomplished by inserting low pressure injector nozzles into engine ports. These engine ports then deliver a cleaning fluid only to the engine compressor area.

SUMMARY

An engine wash apparatus includes a manifold to secure to a nose cone of an engine; a feeder pipe connecting to the manifold to deliver wash liquid to the manifold; a plurality of nozzles connected to the manifold to direct the wash liquid into the engine; a hook connected to the manifold to connect to a slot on the nose cone; and a guide connected to the feeder pipe to align the manifold relative to the engine.

A method of washing an engine with a nose cone includes securing a manifold with a feeder pipe and a plurality of nozzles to the nose cone by engaging a plurality of hooks with slots in the nose cone; aligning the manifold with respect to the engine by connecting a guide on the feeder pipe to an engine component; delivering wash liquid to the feeder pipe on the manifold; and directing the wash liquid toward the engine through a plurality of nozzles connected to the manifold.

DETAILED DESCRIPTION

Figure 1A:
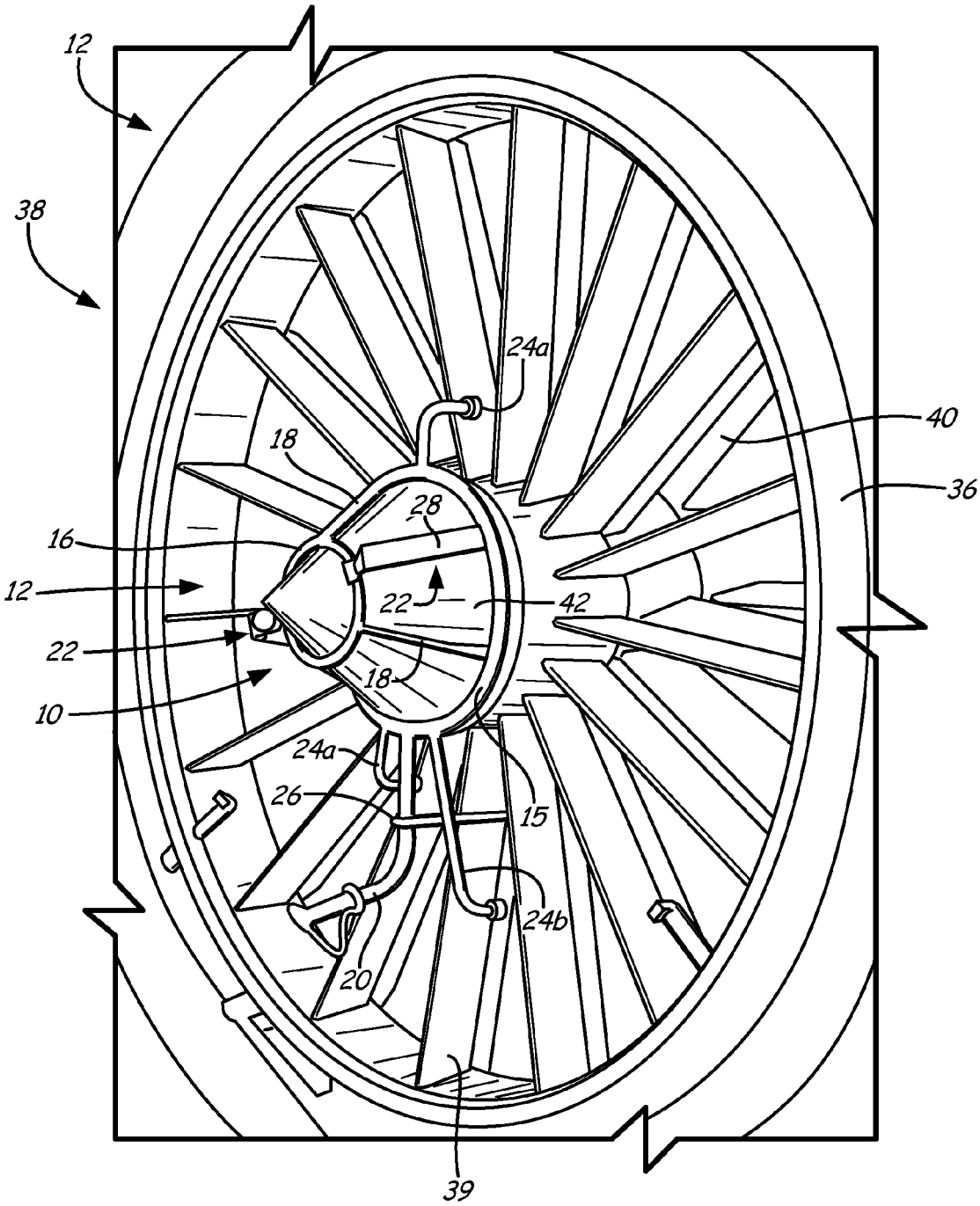
FIG. 1A shows a perspective view of an engine wash apparatus connected to the engine fan.
Figure 1B:
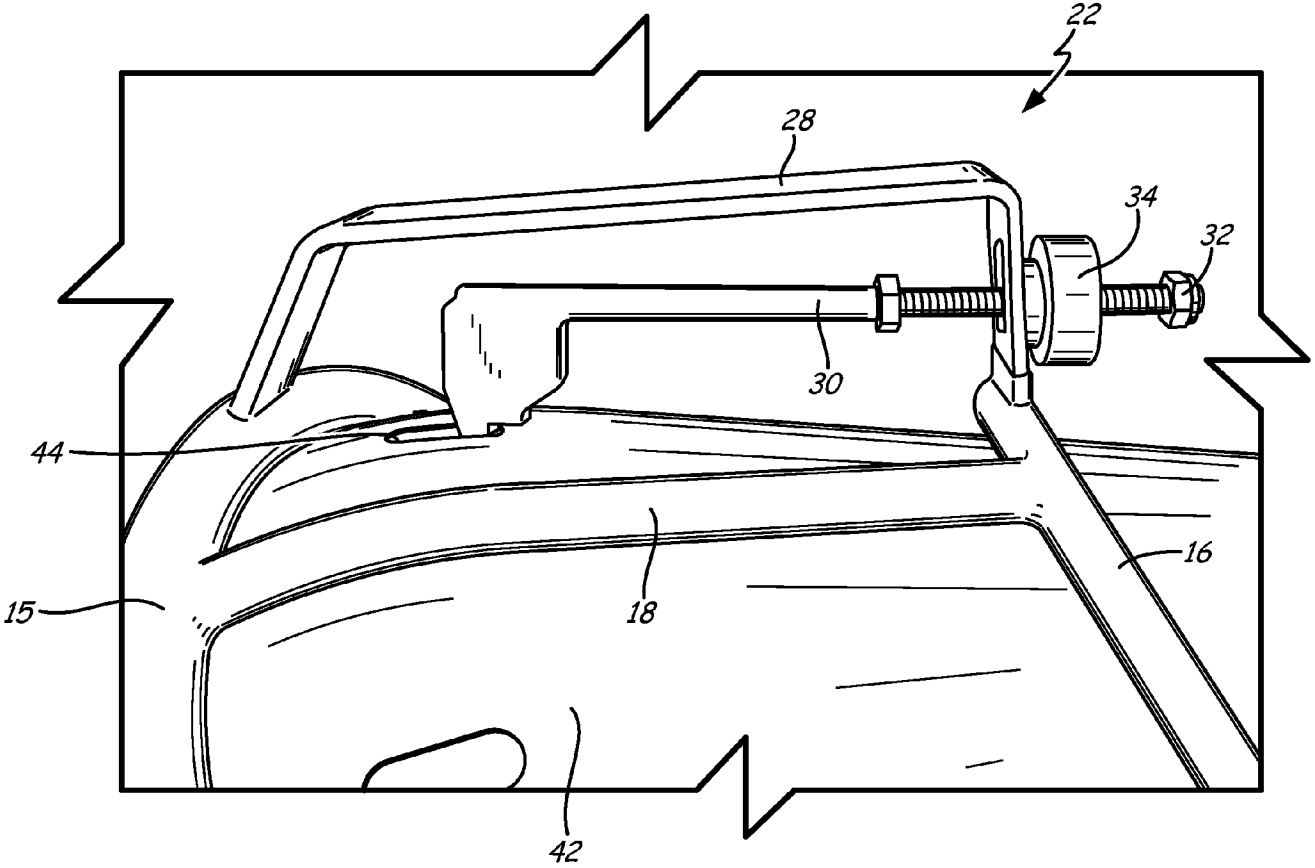
FIG. 1B shows a close up view of a hook of the engine wash apparatus of FIG. 1A connecting to a slot in an engine nose cone.
Figure 1C:
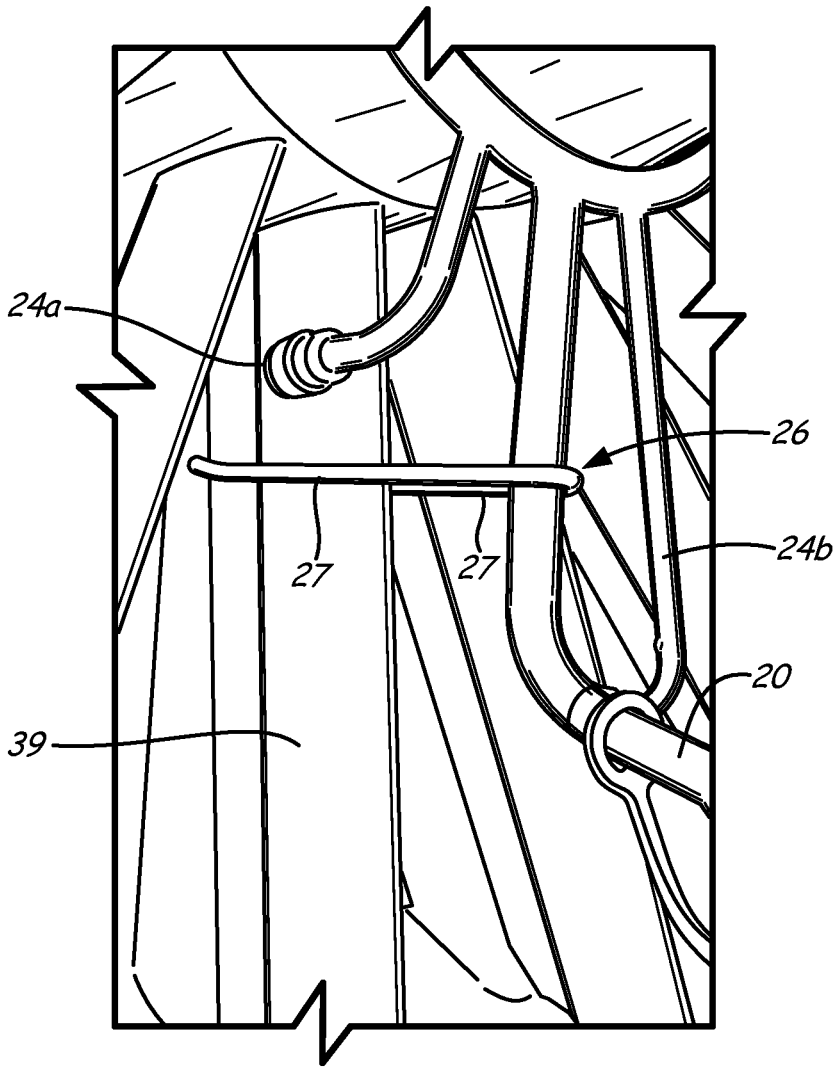
FIG. 1C shows a close up view of a guide of the engine wash apparatus of FIG. 1A connecting to an inlet guide vane.

FIG. 1A shows a perspective view of engine wash manifold 10 connected to engine 12. FIG. 1B shows a close up view of a hook of engine wash manifold 10, and FIG. 1C shows a close up view of guide 26 of engine wash manifold 10. Engine wash manifold 10 includes inner ring 15, outer ring 16, and struts 18; feeder pipe 20; hooks 22; nozzles 24*a* and 24*b*; and guide 26. Hooks 22 include brackets 28, engagement member 30, nut 32 and knurled knob 34. Engine 12 is an F135 aircraft engine, and parts of engine 12 shown include case 36, turbofan 38 with inlet guide vanes 39, blades 40, nose cone 42 with slots 44.

Engine wash manifold 10 connects to engine 12 by connecting to nose cone 42. Inner ring 15, outer ring 16 and struts 18 of manifold 10 are shaped and positioned to connect close and securely around nose cone 42. Inner ring 15 connects to a base (widest part) of nose cone 42 to position nozzles 24*a*, 24*b* axially with respect to engine 12. Struts then connect inner ring 15 with outer ring 16. In the embodiment shown, nozzles 24*a*, 24*b* are about 80 mm to 250 mm from fan blades 40. Engagement members 30 of hooks 22 secure into slots 44 in nose cone 42 by adjusting engagement members 30 and knurled knob 34. Nut 32 is secured to engagement member 30 to provide a captive feature of hook 22. The embodiment of engine wash manifold 10 shown includes two short nozzles 24*a* directed at engine 12 core, and one long nozzle 24 directed at fan blades. Other embodiments could include additional nozzles that direct wash fluid at engine core 12 and fan blades 40. Feeder pipe 20 can connect to a hose delivering a wash liquid.

Engine wash manifold 10 prepares to wash engine 12 by first connecting manifold 10 to nose cone 42, securing with hooks 22 and aligning with guide 26. Hooks 22 secure to nose cone 42 by extending engagement member 30 with knurled knob 34 to a proper length to fit through slot 44 on nose cone 42. Engagement member 30 is then retracted using knurled knob 34 once in slot 44 to provide a securing force for manifold 10, as shown in FIG. 1B.

Guide 26 wraps around feeder pipe 20 and includes two parallel arms 27 which expand outwards and away from each other at the ends. The expanded arms 27 allow guide 26 to slide around sides of inlet guide vane 39, aligning nozzles 24*a* and 24*b* properly and preventing movement of manifold 10 when in a washing operation. Guide 26 is shaped to fit securely around variable inlet guide vane 39 without interfering with or damaging guide vane 39.

Once connected, engine wash manifold 10 can direct a wash liquid toward engine core and blades 40 through nozzles 24*a* and 24*b*. During a wash operation, engine can be motored to assist in flowing wash liquid through engine 12 in the same manner that air and contaminants flow through engine. For washing operations, it may be desirable to motor engine with starter or auxiliary power unit.

Wash liquid is delivered to manifold 10 through feeder pipe 20. Wash liquid can be heated, deionized water only or could include detergent to help with the cleaning process, depending on system needs and requirements. Wash liquid can be temperature regulated for more efficient washing processes by using a heater to increase the temperature, isopropyl alcohol to keep wash liquid from freezing in cold weather or other means depending on system requirements.

Wash liquid delivered to feeder pipe 20 travels through hollow inner ring 15 of manifold 10 to nozzles 24*a*, 24*b*. Short nozzles 24*a* direct fluid toward the core of engine 12 to travel along the same airflow path of contaminants. This can clean contaminants and buildup within engine 12, including in the compressor. Long nozzle 24*b* directs wash fluid at fan blades 40, washing off buildup at the engine intake to keep fan blades 40 aerodynamic and efficient. Nozzles can vary to direct water at different pressures, temperatures and flow rates. Nozzles can also atomize wash liquid.

Manifold 10 can effectively and efficiently wash engine 12 by securing to nose cone 42. Hooks 22 adjust to fit into slots 44 already in nose cone 42 to provide a securing force, keeping manifold 10 in place on nose cone 42 and resisting the force generated by the wash liquid spray through nozzles 24*a* and 24*b*. Guide 26 aligns manifold 10 properly so that nozzles 24*a*, 24*b* direct wash liquid as desired for an effective washing operation. Engine wash manifold 10 can provide a successful and efficient wash for aircraft engine 12, increasing the efficiency and life of engine 12.

Figure 2A:
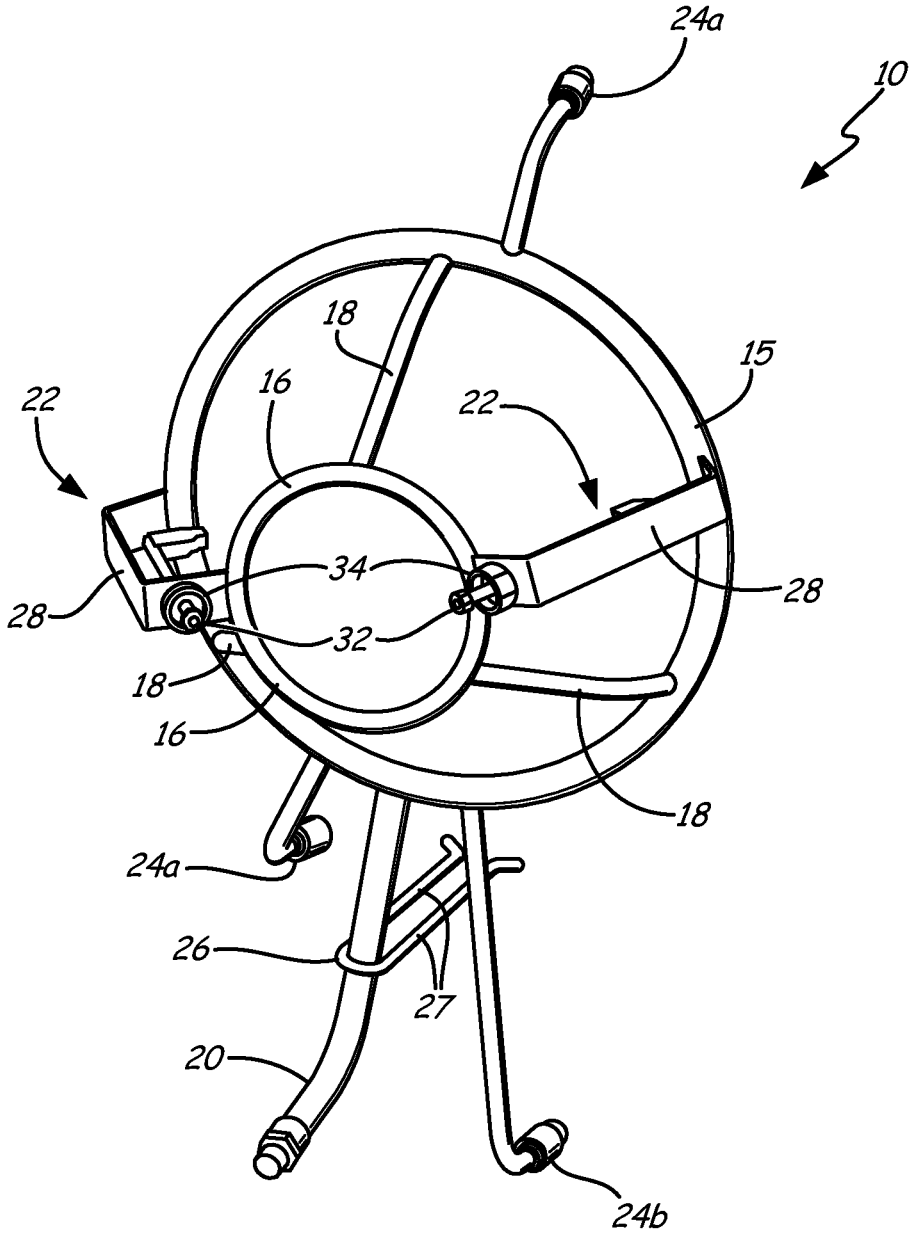
FIG. 2A shows a perspective view from forward of the engine wash apparatus of FIG. 1A.
Figure 2B:
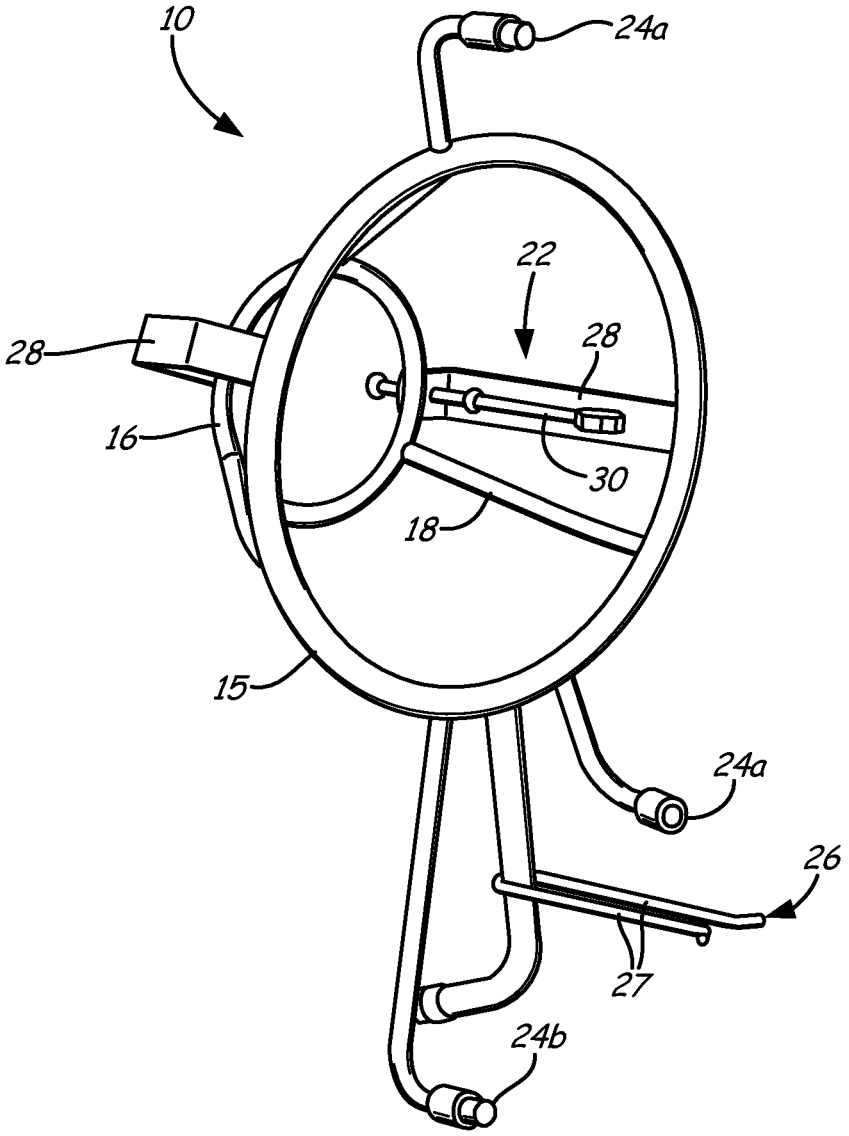
FIG. 2B shows a perspective view from aft of the engine wash apparatus of FIG. 1A.

FIG. 2A shows a perspective view from forward of the engine wash manifold 10 of FIG. 1A, and FIG. 2B shows a perspective view from aft of the engine wash manifold 10. Engine wash manifold 10 includes inner ring 15, outer ring 16, and struts 18; feeder pipe 20; hooks 22 (with brackets 28, engagement member 30, nut 32 and knurled knob 34); nozzles 24*a* and 24*b*; and guide 26.

Engine wash manifold 10 can be made of metal, such as stainless steel. Inner ring 15, outer ring 16, struts 18, brackets 28, guide 26, feeder pipe 20 and nozzles 24*a*, 24*b* can be welded together. Engine wash manifold 10 can be coated in part or whole with a polymer type coating to prevent scratching or marring of surfaces when attaching manifold 10 and hooks 22 to nose cone 42 and guide 26 to vanes 39.

As stated above, engine wash manifold 10 connects to an engine nose cone to secure and align system 10 for an engine washing procedure. Engine wash manifold 10 allows for effective washing of fan blades, engine core and/or any other engine parts desired by aligning manifold 10 with engine so that nozzles 24*a*, 24*b* are specifically directed toward desired parts. Polymer coating on engine wash manifold 10 allows for a secure connection to engine 12 without damaging or scratching any surfaces and protects components of engine wash system from corrosion.

While the embodiments of engine wash system shown are directed toward connecting and washing a conventional F135 aircraft engine, the wash system can be directed toward other variants of the F135 engine, either on or off wing. While the embodiments shown include two short nozzles directed at an engine core and one long nozzle directed at fan blades, other embodiments could include more or fewer nozzles and could direct them differently. While guide 26 is shown connecting to inlet guide vane 39 (FIG. 1A, 1C), guide 26 could be shaped differently to align manifold 10 by connecting to a different engine component.

An engine wash system includes a manifold to secure to a nose cone of an engine; a feeder pipe connecting to the manifold to deliver wash liquid to the manifold; a plurality of nozzles connected to the manifold to direct the wash liquid into the engine; a hook connected to the manifold to connect to a slot on the nose cone; and a guide connected to the feeder pipe to align the manifold relative to the engine.

Additional and/or alternative embodiments include the manifold being coated with a polymeric coating; the plurality of nozzles including at least one nozzle directing wash liquid into a core of the engine; the plurality of nozzles including at least one nozzle directing wash liquid at blades in the engine; the manifold comprising an outer ring to connect around the nose cone; a hollow inner ring connecting to a base of the nose cone that allows the wash fluid to flow from the feeder pipe to the nozzles; and a plurality of struts between the outer ring and the inner ring; the hook comprising a bracket connected to the inner ring and the outer ring; an engagement member able to move forward and aft relative to the bracket and to engage the slot in the nose cone; a nut connecting to the engagement member and able to move forward and aft relative to the bracket; and a knurled knob connected to the engagement member to secure the engagement member relative to the bracket; the plurality of nozzles and the feeder pipe connecting to the inner ring; the hook comprising a plurality of hooks connected to the manifold to connect to a plurality of slots on the nose cone; and/or each of the plurality of hook comprising a bracket connected to the inner ring and the outer ring; an engagement member able to move forward and aft relative to the bracket and to engage the slot in the nose cone; a nut connecting to the engagement member and able to move forward and aft relative to the bracket; and a knurled knob connected to the engagement member to secure the engagement member relative to the bracket.

An engine wash system includes a manifold to connect to an engine, the manifold comprising a ring to connect to an engine nose cone; a feeder to deliver wash liquid to the manifold; nozzles to direct wash liquid into the engine; and a hook for engaging a slot in the nose cone of the engine.

Additional and/or alternative embodiments include the manifold further comprising a plurality of hooks for engaging a plurality of slots in the nose cone; each of the plurality of hooks comprising a bracket connected to the manifold; an engagement member able to move forward and aft relative to the bracket and to engage the slot in the nose cone; a nut connecting to the engagement member and able to move forward and aft relative to the bracket; and a knurled knob connected to the engagement member to secure the engagement member relative to the bracket; the manifold further comprising a guide to align the manifold relative to the engine; the manifold being covered with a polymeric coating; the plurality of nozzles including at least one nozzle directing wash liquid into a core of the engine; and/or the plurality of nozzles including at least one nozzle directing wash liquid at fan blades in the engine;

A method of washing an engine with a nose cone includes securing a manifold with a feeder pipe and a plurality of nozzles to the nose cone by engaging a plurality of hooks with slots in the nose cone; aligning the manifold with respect to the engine by connecting a guide on the feeder pipe to an engine component; delivering wash liquid to the feeder pipe on the manifold; and directing the wash liquid toward the engine through a plurality of nozzles connected to the manifold.

Additional and/or alternative embodiments include the step of directing the wash liquid toward the engine through a plurality of nozzles comprising directing a portion of the wash liquid at a core of the engine; and directing a portion of the wash liquid at fan blades in the engine; and/or the method being for washing a conventional F135 engine on or off wing While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An engine wash system comprising:

a manifold to secure to a nose cone of an engine, wherein the manifold comprises:

an outer ring to connect around the nose cone; and an inner ring connecting to a base of the nose cone that allows the wash fluid to flow from the feeder pipe to the nozzles;

a feeder pipe connecting to the manifold to deliver wash liquid to the manifold;

a plurality of nozzles connected to the manifold to direct the wash liquid into the engine;

a hook connected to the manifold, wherein the hook comprises:

an engagement member having an engagement prong movable forward and aft between maximum and minimum extents, wherein the maximum and minimum extents are defined between the outer ring and the inner ring; and a guide connected to the feeder pipe to align the manifold relative to the engine.

2. The engine wash system of claim 1, wherein the manifold is coated with a polymeric coating.

3. The engine wash system of claim 1, wherein the plurality of nozzles include at least one nozzle directing wash liquid into a core of the engine.

4. The engine wash system of claim 1, wherein the plurality of nozzles include at least one nozzle directing wash liquid at fan blades in the engine.

5. The engine wash system of claim 1, wherein the manifold further comprises:

a plurality of struts between the outer ring and the inner ring.

6. The engine wash system of claim 1, wherein the hook comprises:

a bracket connected to the inner ring and the outer ring;

a nut connecting to the engagement member and able to move forward and aft relative to the bracket; and a knob connected to the engagement member to secure the engagement member relative to the bracket.

7. The engine wash system of claim 1, wherein the plurality of nozzles and the feeder pipe connect to the inner ring.

8. The engine washing system of claim 1, and further comprising:

an additional hook connected to the manifold, wherein the hook and the additional hook are located at circumferentially opposite locations.

9. The engine washing system of claim 8, wherein the additional hook comprises:

a bracket connected to the inner ring and the outer ring;

an engagement member able to move forward and aft relative to the bracket and to engage the slot in the nose cone;

a nut connecting to the engagement member and able to move forward and aft relative to the bracket; and a knob connected to the engagement member to secure the engagement member relative to the bracket.

10. An engine wash system comprising:

a manifold to connect to an engine, the manifold comprising:

a ring to connect to an engine nose cone;

a feeder pipe to deliver wash liquid to the manifold;

nozzles to direct wash liquid into the engine; and a hook for engaging a slot in the nose cone of the engine, wherein the hook is connected to the ring, the hook comprising:

a bracket connected to the ring, the bracket having a forward end and an opposite aft end; and an engagement member supported by the bracket, the engagement having an engagement prong movable forward and aft between maximum and minimum extents, wherein the maximum and minimum extents are located in between the forward end and the aft end of the bracket.

11. The engine wash system of claim 10, wherein the manifold further comprises:

an additional hook for engaging an additional slot in the nose cone.

12. The engine wash system of claim 11, wherein of the additional hook comprises:

a bracket connected to the manifold;

an engagement member able to move forward and aft relative to the bracket and to engage the slot in the nose cone;

a nut connecting to the engagement member and able to move forward and aft relative to the bracket; and a knob connected to the engagement member to secure the engagement member relative to the bracket.

13. The engine wash system of claim 10, and wherein the manifold further comprises:

a guide to align the manifold relative to the engine.

14. The engine wash system of claim 10, wherein the manifold is covered with a polymeric coating.

15. The engine wash system of claim 10, wherein the nozzles include at least one nozzle directing wash liquid into a core of the engine.

16. The engine wash system of claim 15, wherein the nozzles further include at least one additional nozzle directing wash liquid at fan blades in the engine.

17. The engine wash system of claim 10, wherein the bracket is configured as a generally U shaped wall, wherein the engagement prong of the engagement member is positioned radially inward from the generally U shaped wall, wherein the engagement member passes through an opening in the generally U shaped wall.

18. The engine wash system of claim 17, the hook further comprising:

a knob located on an opposite side of the generally U shaped wall from the engagement prong.

19. The engine wash system of claim 10 and further comprising:

an additional ring, wherein the bracket is connected to the additional ring.

20. An engine wash system comprising:

a manifold to secure to a nose cone of an engine, wherein the manifold comprises:

an outer ring to connect around the nose cone; and an inner ring connecting to a base of the nose cone that allows the wash fluid to flow from the feeder pipe to the nozzles;

a feeder pipe connecting to the manifold to deliver wash liquid to the manifold;

a plurality of nozzles connected to the manifold to direct the wash liquid into the engine;

a hook connected to the manifold, wherein the hook comprises:

a bracket connected to the inner ring and the outer ring;

an engagement member able to move forward and aft relative to the bracket and to engage the slot in the nose cone;

a nut connecting to the engagement member and able to move forward and aft relative to the bracket; and a knob connected to the engagement member to secure the engagement member relative to the bracket; and a guide connected to the feeder pipe to align the manifold relative to the engine.

* * * * *

UNITED STATES PATENT AND TRADEMARK OFFICE

CERTIFICATE OF CORRECTION

PATENT NO. : 9,034,111 B2
APPLICATION NO. : 13/562883
DATED : May 19, 2015
INVENTOR(S) : Dorshimer et al.

It is certified that error appears in the above-identified patent and that said Letters Patent is hereby corrected as shown below:

In the Claims col. 4, lines 52 to 54, delete "that allows the wash fluid to flow from the feeder pipe to the nozzles"

col. 4, line 65, after "the inner ring" insert -- that allows the wash liquid to flow from the feeder pipe to the nozzles -- col. 6, lines 37 to 39, delete "that allows the wash fluid to flow from the feeder pipe to the nozzles"

col. 6, line 46, after "the inner ring" insert -- , that allows the wash liquid to flow from the feeder pipe to the nozzles, --

Signed and Sealed this
First Day of March, 2016

Michelle K. Lee

Michelle K. Lee
*Director of the United States Patent and Trademark Office*